US005108113A

United States Patent [19]

Leach

[11] Patent Number: 5,108,113

[45] Date of Patent: Apr. 28, 1992

[54] PHONICS CARD GAME

[76] Inventor: Leonora M. Leach, 113-15 34th Ave., Corona, N.Y. 11368

[21] Appl. No.: 620,753

[22] Filed: Dec. 3, 1990

[51] Int. Cl.[5] ..... A63F 1/00; G09B 1/00

[52] U.S. Cl. ..... 273/302; 273/308; 434/159; 434/167

[58] Field of Search ..... 273/299, 302, 308, 272; 434/171, 172, 176, 167, 159

[56] References Cited

U.S. PATENT DOCUMENTS

| | | | |
|---|---|---|---|
| 1,732,980 | 8/1927 | Mooney | 273/299 |
| 2,000,812 | 5/1935 | Adams | 273/299 |
| 2,361,154 | 10/1944 | Schoolfield | 434/167 |
| 2,635,360 | 4/1953 | Bishop | 434/172 |
| 4,773,651 | 9/1988 | Papapavlou | 273/299 |

*Primary Examiner*—Benjamin Layno
*Attorney, Agent, or Firm*—Jordan and Hamburg

[57] ABSTRACT

The present invention, designed especially for preschoolers, is a phonics card game comprising in combination eight decks of letter cards, word cards and short- and long-vowel sound cards. This phonics card game is comprehensive and fun. As the players play with this card game, they see and name all the letters of the alphabet; they show the sequence of the alphabet; they separate vowel from consonant letters and have a special vowel and consonant category for W's and Y's; and they match lower-case letters with capital letters having the same name. As the players play with this card game they hear and say the short- and long-vowel sounds; they see and say one-syllable short- and long-vowel words; and they see, clap, and say words with one or more syllables. The players can win this card game without using up all the cards in a deck. They merely have to have the most stars, which are exchanged for points earned when players say a letter or word correctly on the first try. As the players play with the present invention, then have fun, show what they know, and gain the rudiments of phonics.

1 Claim, 2 Drawing Sheets

PHONICS CARD GAME

FIELD OF THE INVENTION

The present invention relates to card games. More specifically, the present invention relates to phonics card games.

BACKGROUND OF THE INVENTION

Card games are played by adults or are a family-type game. Usually, the card games played by children require that players utilize letters, word parts, or words having the medial vowel missing but having accompanying pictures, to make and say words.

In some games, players must match word parts to word parts highlighted in words as in the game by Havard U.S. Pat. No. 4,826,437.

Those card games geared to preschoolers have required players to match pictures on cards dealt to them with those dealt face down to the table. Even though other players advantageously can learn the picture and location of the card that cannot be matched, and the game itself is fun, no letters or words are learned.

SUMMARY OF THE INVENTION

The present invention is geared especially to preschoolers. Preschoolers are language teachable. They like to test their knowledge; they enjoy showing what they know; and they love to win playing cards the way grownups do. While playing with the present card game, which comprises eight decks of letter or word cards and short-and long-vowel sound cards, players see and say letters or words and gain the rudiments of phonics.

This phonics card game is comprehensive. It progresses from simple to difficult; capital letter cards undergird word cards. It is also challenging. Preschoolers can pick the deck of cards that they want, depending on what they think they have mastered, what they desire, or the challenge that they want.

Additionally, this card game is flexible. The rules can be predetermined by the players, making the game simple or difficult. The game can be made simple by dealing all the cards exposed. Thus, the players can silently learn from each other. On the other hand, the game can be made difficult by dealing all the cards face down, letting the players confidently say the letter or word on their card when their turn comes. Similarly, the players can agree to deal every other card face down.

Players can win this card game without using up all the cards in a deck. They merely have to have the most stars. Stars are exchanged for points which are earned when a player says a letter or word correctly on the first try. Ideally, at least four players play this card game. Actually, two can play if the players are serious and want to show what they know. Conceivably, one can play if the player has mastered enough to enjoy the game alone.

Preschoolers can play this card game at home with friends, in a day-care or head-start setting, or in a kindergarten. Wherever preschoolers play this card game, they can have fun, show what they know, and gain the rudiments of phonics.

Like learning a first language, this card game is a game of silence and report. Silence is attending, looking, and listening. Report is having a turn and saying a letter or word. The cards are dealt to the players, and one hand is dealt to the middle of the table.

One object of playing with the capital letter cards is to see and name all letters of the alphabet. The players sort the cards according to those letters that look alike, and then they name each letter group.

Another object of playing with the capital letter cards is to show the sequence of the letters of the alphabet.

Still another object of playing with the capital letter cards is to separate the vowels from the consonants and to put the W's and Y's in a separate vowel and consonant category.

The object of playing with the capital letter cards and the matching lower-case letter cards is to match the lower-case letters with the capital letters having the same name.

The sounds of the vowels are derived from short-vowel sound cards and long-vowel sound cards. Players have access to these cards when playing with the word cards.

The object of playing with the short-vowel sound cards is to hear and say the short-vowel sounds of the vowel letters seen in the beginnings of the words that are associated with the simple pictographs on the short-vowel sound cards.

The object of playing with the long-vowel sound cards is to practice saying the long-vowel sounds of the letters that are seen.

Although the players have access to cards pertaining to vowel sounds, and they know the names of the consonant letters, they must derive the sounds of the consonant letters from familiar names or familiar words.

Thus, one object of playing with the short-vowel word cards is to use the consonant-letter sound and the short-vowel sound to say the word on the card.

Another object of playing with the short-vowel word cards is to practice saying the short-vowel sounds in words.

The object of playing with the long-vowel word cards is to say the long-vowel sounds in words while noting that a long-vowel sound might have a few spellings.

There is a deck of word cards with a shorter matching set of words having the short- or the long-vowel sound.

The object of playing with these cards is to see and say words having the short- or the long-vowel sound.

As the preschoolers become more confident, they attempt playing with the deck of word cards having words with one or more syllables.

The object of playing with these cards is to see, clap, and then say the syllables in a word.

Playing with the present invention might cause preschoolers, who not only learn easily but are very creative, to think of other objects of playing with this card game. They might want to let words learned via phonics become sight words. Here, word cards would be dealt to the players face down, and the object of playing with the word cards would be to turn over the top card and say its word as quickly as possible. Thus, it can be seen that the following description of the drawings and the description of the card game are simply illustrative of the invention.

DESCRIPTION OF THE PREFERRED EMBODIMENT

Figure 1:
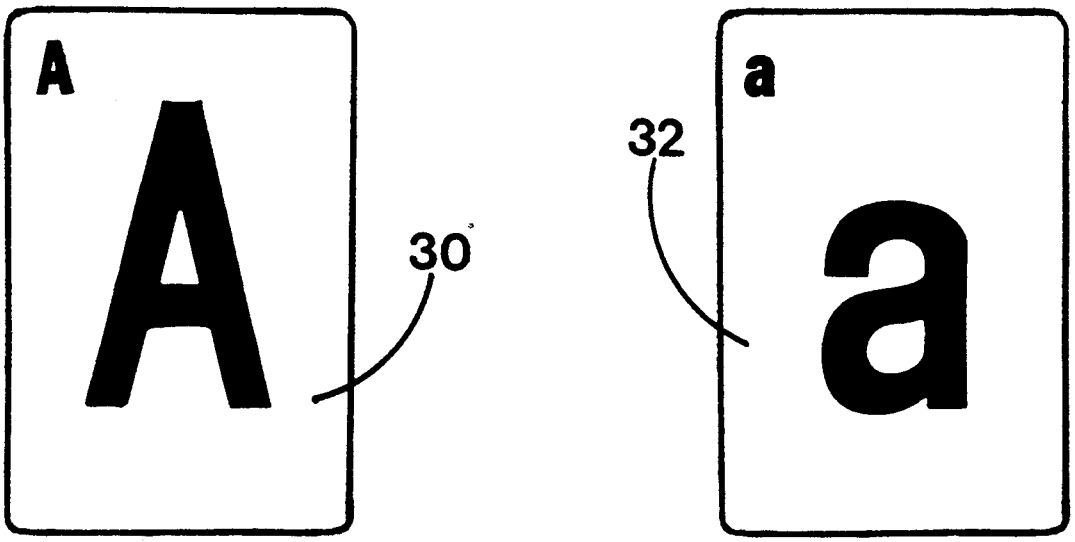
FIG. 1 illustrates the capital letter cards and the lower-case letter cards of the present invention.
Figure 2:
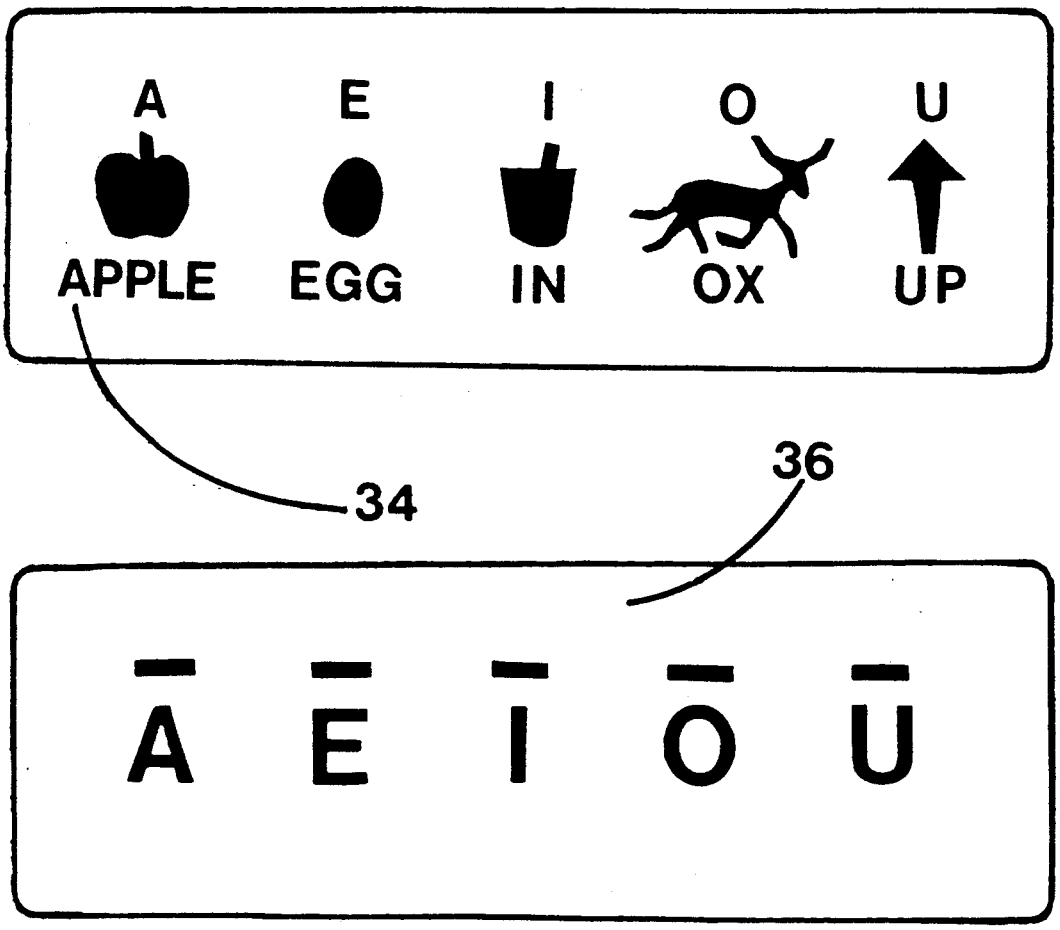
FIG. 2 illustrates the short-vowel sound cards and the long-vowel sound cards which are a part of the present invention.

The present invention is a card game with eight decks of cards. The capital letter cards 30 in FIG. 1 have two decks; the lower-case letter cards 32 in FIG. 1 have one deck; the short-vowel word cards 38 in FIG. 3 have one deck; the long-vowel word cards 40 in FIG. 3 have one deck; there is a deck with a shorter matching set of short- or long-vowel word cards 38A and 40A in FIG. 3; and a deck of cards 42 in FIG. 3 with words having one or more syllables. There are eighty-four capital letter cards 30—three for each letter of the alphabet plus three extra W and three extra Y cards. The decks divide the alphabet into two sections. The first section, A to M, has thirty-nine cards, while the second section, N to Z plus the three extra W and the three extra Y cards, has forty-five cards. The lower-case letter cards 32, which comprise a fifty-three card deck, have two cards for each letter of the alphabet. The cards are divided by a blank barrier card which separates A to M from N to Z. These letter cards, which the preschoolers play with while learning the alphabet, undergird the word cards. That is, the letters in the words on the word cards become familiar.

When the preschoolers play with the word cards, they have access to sound cards. There is a deck of five short-vowel sound cards 34 and five long-vowel sound cards 36. The short- and long-vowel sound cards 34 and 36 are as long as the width of the other cards and as wide as twice their length.

Figure 3:
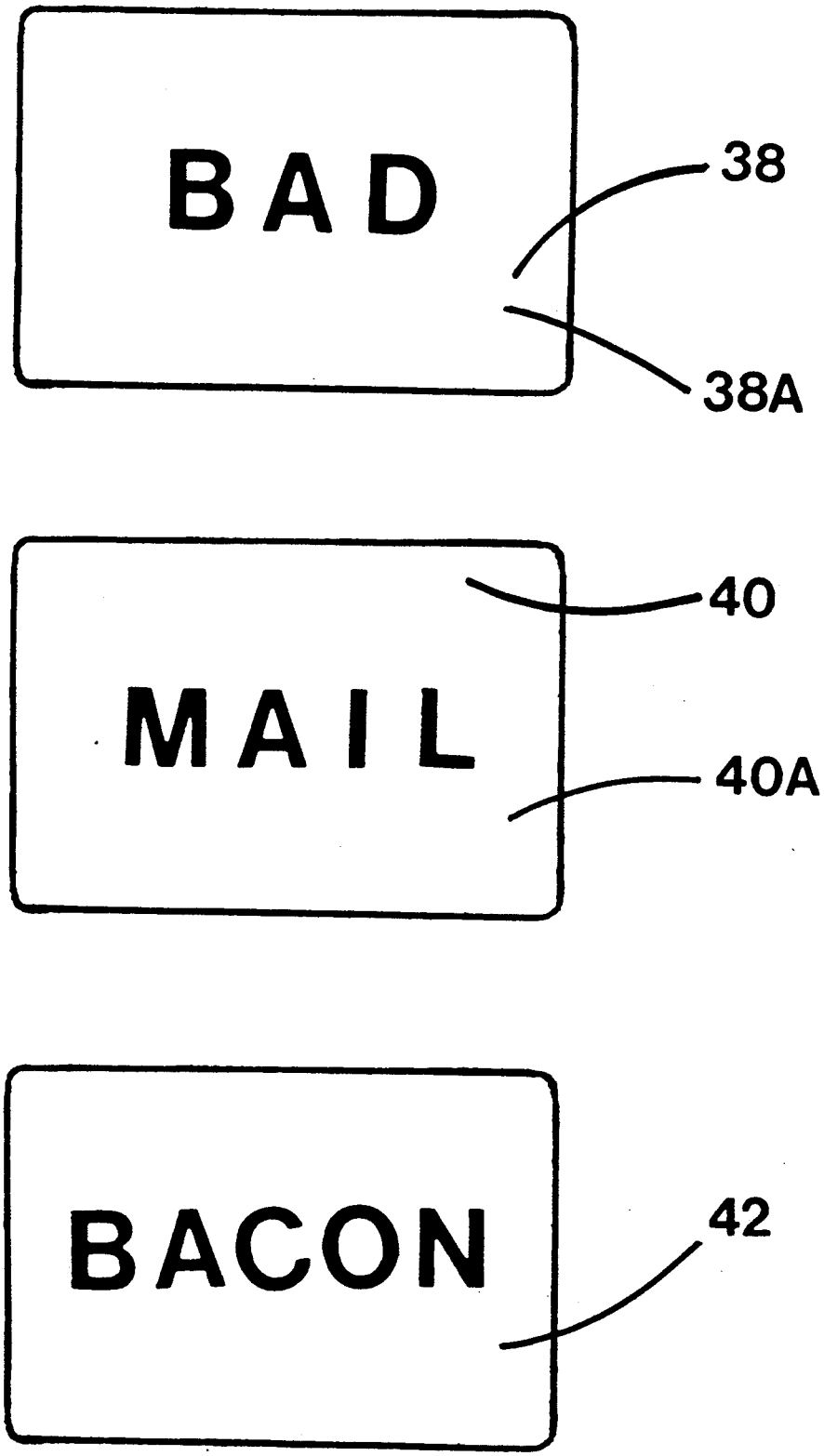
FIG. 3 illustrates the short-vowel word cards, the long-vowel word cards, a shorter matching set of short- or long-vowel word cards, and cards with words having one or more syllables. These word cards are a part of the card game which is the present invention.

There are seventy-one short-vowel word cards 38 in FIG. 3 in a deck and thirty-nine long-vowel word cards 40 in FIG. 3 in a deck. The shorter matching set of short- or long-vowel word cards 38A and 40A in FIG. 3 comes in a deck of forty-three cards, and the deck of cards 42 in FIG. 3 with words having one or more syllables has twenty-one cards. Playing with these word cards requires that the preschoolers utilize their attention, their eyes, and their ears in certain ways.

In the present invention, the players compete by learning and showing what they have learned. This is a game of silence and report. Players are silent until their turn comes to report. They can learn from each other by listening for the names or sounds of the letters. The players can practice within themselves until their turn comes to say the letter or word.

Intially, the players are simply required to see what capital letters look like and say their names. For example, after all the capital letter cards 30—that is, one of the decks from A to M or from N to Z—have been given out, the players, in turn, put down the letters, making groups of letters if the letters look the same. When all the letters have been played or put down, the players take turns naming each letter group. One point is earned when a letter group is named correctly. Six points earn a star, and the player with the most stars wins.

In this card game, the table is treated as a player without a turn. The middle of the table is used so that it can be seen easily by all the players. All the table's cards are dealt face up, and the players are able to utilize these cards to their advantage. For example, if a player sees a capital letter that he or she has, the player can put down his or her letter card on that of the table's, or if the player sees two capital letters that look the same, their cards can be combined in one pile, and the player still has a turn. The small replicas of the letters on the cards' upper left-hand corner allow easy viewing.

Also, more experienced players might opt to combine the object of seeing and naming the capital letters in one play. For example, after all the capital letter cards 30 have been given out, the players could put down a card and say its letter. This would be decided beforehand by the players. Players would still be required to make groups of letters that look the same.

After the players become familiar with the capital letters and the capital letter's names, they can learn the correct sequence of the letters of the alphabet with these same capital letters cards 30. When all the cards have been given out, the player with the letter A puts down the first card. If two players have the letter A it will have to be decided where the game will start. Then, the players, in turn, put down the card with the letter that is next in the sequence of the alphabet. While taking their turns, the players can throw off cards that have letters that have already been played. Play continues until the sequence of the alphabet is complete. An alphabet song can be used as a guide to the sequence of the alphabet. Lyrics for one such song are available "© 1990 Leonora Leach"(410 (*a*) 17 U.S.C). A point is earned when a capital letter card 30 continuing the sequence of the alphabet is played. In this card game, six points earn a star when playing with the letter cards and three points earn a star when playing with the word cards. In both cases, the player with the most stars wins.

The capital letter cards 30 can also be used to separate the vowel letters from the consonant letters and to put the extra W and Y letters in a separate vowel and consonant category. After all the capital letter cards 30 have been given out, the first player names the letter on his or her card and puts the card in either the vowel or the consonant pile. The next player picks a different letter, names it, and puts the capital letter card 30 in the appropriate pile. The player who picks a W or a Y card puts the card in either the consonant pile or the W and Y pile. A Vowel and Consonant Ditty "© Leonora Leach" (410 (*a*) 17 U.S.C.) can be used by the players to separate the vowel, consonant, and W and Y categories. The player who picks the W and Y pile, says that these two consonants sometimes act as vowels. A player earns one point by putting the capital letter card 30 in the appropriate pile.

The capital letter cards 30 are used in conjunction with the lower-case letter cards 32 to match the lower-case and capital letters that have the same name. After all of the cards have been given out, the first player puts down a capital letter card 30 and names its letter. The next player puts down its matching lower-case letter. The players continue in turn until all the lower-case letter cards 32 have been used. The players make piles of letters with the same name as they throw down cards with capital or lower-case letters that have been played. If the capital letter is properly matched, one point is earned.

Heretofore, while playing with the letter cards, the players have been highly motivated by the chance to play cards and win and the chance to learn; however, the short-vowel sound cards 34 introduce the element of problem-solving. The short-vowel sound cards 34 are used to let players hear, see, and say the short-vowel sounds. Each player is given a short-vowel sound card 34. The first player says the word that is associated with the pictograph under the A that is on the card. The player continues to say the word slowly while all the other players listen for the A's short-vowel sound. The next player says the same word, the name of the vowel, and its short-vowel sound. This continues until all of the players have had a similar turn with the A's short-vowel sound. The rest of the vowels are handled in the same way. A point is earned when a player says correctly the word, the name of its vowel, and the vowel's short sound on the first try. Of course, a turn can consist of many tries. Here, three points earn a star, and the player with the most stars wins.

The short-vowel sound cards 34 introduce the element of problem solving to the players, but the real challenge is in playing with the word cards. Their words are all different, and they are all dealt exposed. The players can learn from each other as they say the words on the cards similar to the way they learned from others when saying their spoken language. A player can see any hand, including the table's, but can only say a word on a word card dealt to him or her or to the table. Here, the object is to say correctly on the first try as many words as possible.

When playing with the short-vowel word cards 38, the players have access to the short-vowel sound cards 34. Even though the consonant letters are familiar faces from playing with the capital letter cards 30, the sounds of these consonant letters will have to be derived from familiar names or from familiar words or from the plays of the other players. After seven of the short-vowel word cards 38 have been dealt to each player, the players sort the word cards according to the beginning consonant letter. The letter X is sorted according to the ending consonant. The player is first who thinks that he or she has a play, that is, can say correctly on the first try a word on a short-vowel word card 38 dealt to him or her or to the table. A game monitor is on hand to monitor whether or not the word is said or reported correctly. If the word has been incorrectly reported, the game monitor or a volunteer player gives the correct report. The player with the same beginning consonant letter and the same vowel letter takes the next turn. If this is not possible, the player with just the same beginning consonant letter is next. When this is not possible, any word can be used for a turn. The game continues in this way until all the short-vowel sound cards 38 are similarly used. A point is earned when a player says a word correctly on the first try.

Another object of playing with the short-vowel word cards 38 is to practice seening and saying the short-vowel sounds in words. Here, after all the short-vowel word cards 38 have been given out, the players sort the short-vowel word cards 38 according to the vowel letter. Within these vowel groups, the players sort the cards according to the ending consonant letter. For example, all AD's go together, and all AN's go together. Again, the player who thinks he or she can say a word correctly on the first try goes first. The game monitor says whether or not the word has been correctly reported. If it has not, a volunteer player can say the word. The game monitor says the word if no volunteer player can say the word correctly. The next player puts down a card and says its word. The game continues in this way until all the cards are used. The players earn a point by saying a word correctly on the first try.

The object of playing with the long-vowel sound cards 36 is to practice saying the long-vowel sounds. Since the long-vowel sounds are the same as the names of the vowels, the vowels, with their long-vowel diacritic, remind the players that the names and sounds of the long vowels are the same. When the players play with the long-vowel sound cards 36, they take turns saying the long-vowel sounds. A point is earned when a player says the correct long-vowel sound on the first try.

The object of playing with the long-vowel word cards 40 is to say the long-vowel sounds in words while noting that a long-vowel sound might have a few spellings. After all the long-vowel word cards 40 have been given out, the players sort the cards according to the first vowel letter. The player who thinks that he or she can say the word correctly on the first try goes first. The game monitor says if the word has been reported correctly. If not, a volunteer player says the word. If the volunteer player fails to report the word correctly, the game monitor says the word. The player who puts down the card names the word's silent letter, if there is any. At the same time, the player says whether the silent letter comes right after the first vowel or at the end of the word. The players take turns seeing and saying the word. The player who thinks he or she can say a word correctly on the first try goes next. The game continues in this way until all the long-vowel word cards 40 are used. A point is earned when a player says a word correctly on the first try.

There is a deck of word cards 40A with a shorter matching set of words having the short- or the long-vowel sound. The object here is to see and say words having either the short- or the long-vowel sound. After all the cards have been given out, the players sort the words according to the first or only vowel letter. The player who thinks that he or she can say a word correctly on the first try goes first. The game monitor says whether or not the word has been reported correctly. If not, a volunteer player or the game monitor says the word. The next player puts down a card having a word with the same vowel sound and says the word. If this is not possible, a player having a word with the same vowel sound and nearest in line for a turn takes the play by putting down his or her card and saying its word. The next player puts down any card and says its word. The game continues in this way until all the cards are used. Saying a word correctly on the first try earns a point.

Finally, there is a deck of word cards 42 with words having one or more syllables. The object of playing with these cards is to see and clap the syllables in a word and then to say the word. After all the cards have been given out, the game monitor say that a clap or syllable is like a word with a short- or a long-vowel sound. The game monitor says that a clap or syllable that ends with a vowel is like a one-syllable word with a long-vowel sound, and if a clap or syllable ends with a consonant, it is like a one-syllable word with a short-vowel sound. Clapping helps the players see where one syllable ends and another begins. They sort the cards according to the word's first letter. The player who thinks he or she can clap and say a word correctly on the first try goes first. The game monitor says whether this play has been made correctly. If it has not, another player can volunteer to make the play. If this is not done correctly, the game monitor makes the play. The players, in turn, experience the word. While clapping, the players look for double consonants; they look for a consonant between two vowels; and the look for two vowels together. The player who feels ready to clap and say a word correctly on the first try goes next. The players continue in this way, taking turns, until all the cards are used. A point is earned when a player claps and says a word correctly on the first try. In the present invention, points are earned as the players exhibit their skill. Also, the invention is extensive and flexible. The players choose decks according to their skill and/or interest.

What is claimed is:

1. A phonics card game consisting of in combination:

a first deck of cards wherein each card of said first deck having a capital letter from A to M printed thereon, a small replica of which is printed on one of the upper corners of said cards;

a second deck of cards wherein each card of said second deck having a capital letter from N to Z printed thereon, a small replica of which is printed on one of the upper corners of said cards;

a third deck of cards and a blank barrier card wherein each card of said third deck having a lower-case letter from a to z printed thereon, a small replica of which is printed on one of the upper corners of said cards, and having the said blank barrier card dividing the first half from the second half of said third deck of cards;

a fourth deck of cards divided into a first set and a second set of cards and having a blank barrier card dividing the two sets, wherein each card of the first set of cards in said fourth deck representing the short-vowel sounds and having the five vowel capital letters, five words, each word having one of the five different short vowel sounds to represent the five short vowel sounds, and five illustrated objects representing each of said five words in illustrative form printed thereon, and wherein each card of the second set of cards in said fourth deck representing the long-vowel sounds and having the five vowel capital letters with their corresponding long-vowel diacritic printed thereon, and having the said blank barrier card dividing the two sets;

a fifth deck of cards wherein each card of said fifth deck having a different short-vowel word printed thereon;

a sixth deck of cards wherein each card of said sixth deck having a different one-syllable long-vowel word printed thereon;

a seventh deck of cards divided into a first set and a second set of cards wherein each card of the first set of cards in said seventh deck having a different one-syllable short-vowel word printed thereon and wherein each card of the second set of cards in said seventh deck having a different one-syllable long-vowel word printed thereon;

an eighth deck of cards divided into a first, a second and a third set of cards, wherein each card of the first set of cards in said eighth deck having a different one-syllable word printed thereon, and wherein each card of a second set of cards in said eighth deck having a different two-syllable word printed thereon, and wherein each card of a third set of cards in said eighth deck having a different three-syllable word printed thereon.

* * * * *